United States Patent [19]

Takei et al.

[11] Patent Number: 4,784,587

[45] Date of Patent: Nov. 15, 1988

[54] PUMP APPARATUS

[75] Inventors: Toshihiro Takei, Okazaki; Yoshiyuki Hattori, Toyoake; Yutaka Kawashima, Okazaki; Tetuya Izumi, Kariya; Yoshifumi Ina, Okazaki; Takeshi Matsuda, Aichi, all of Japan

[73] Assignee: Nippondenso Co., Ltd., Kariya, Japan

[21] Appl. No.: 871,118

[22] Filed: Jun. 5, 1986

[30] Foreign Application Priority Data

| | | | |
|---|---|---|---|
| Jun. 6, 1985 | [JP] | Japan | 60-123357 |
| Jun. 6, 1985 | [JP] | Japan | 60-123358 |
| Jun. 6, 1985 | [JP] | Japan | 60-123359 |
| Aug. 10, 1985 | [JP] | Japan | 60-17642 |

[51] Int. Cl.[4] ..... F04B 17/00; F04B 35/04

[52] U.S. Cl. ..... 417/423.6; 417/423.14; 417/423.1

[58] Field of Search ..... 417/366, 423 R, 423 F, 417/423 G, 423 L, 423 P, 423 T, 365, 244, 420, 205; 415/53 T, 213 T, 198.2

[56] References Cited

U.S. PATENT DOCUMENTS

| | | | |
|---|---|---|---|
| 3,315,607 | 4/1967 | McInnes . | |
| 3,418,991 | 12/1968 | Shultz et al. | 417/423 B |
| 3,658,444 | 4/1972 | Rhodes et al. | 415/53 T |
| 4,295,797 | 10/1981 | Ruhl et al. | 417/205 |
| 4,445,820 | 5/1984 | Hayashi et al. | 417/366 |
| 4,445,821 | 5/1984 | Watanabe et al. | 417/423 P |
| 4,449,891 | 5/1984 | Kemmner | 417/423 R |
| 4,451,213 | 5/1984 | Takei et al. | 417/366 |
| 4,466,781 | 8/1984 | Kemmner et al. | 417/423 T |
| 4,478,550 | 10/1984 | Watanabe et al. . | |
| 4,516,915 | 5/1985 | Jensen et al. | 417/423 P |
| 4,573,882 | 3/1986 | Watanabe et al. | 417/366 |

FOREIGN PATENT DOCUMENTS

| | | | |
|---|---|---|---|
| 448450 | 8/1927 | Fed. Rep. of Germany | 415/53 T |
| 57-157094 | 9/1982 | Japan . | |
| 57-206795 | 12/1982 | Japan . | |
| 59-43692 | 3/1984 | Japan . | |

*Primary Examiner*—Donald E. Stout

*Attorney, Agent, or Firm*—Cushman, Darby & Cushman

[57] ABSTRACT

A pump apparatus comprises a pump housing, an impeller having a plurality of radial grooves rotatably disposed within the pump housing, first and second fluid passages each defined by the impeller and the pump housing at both sides of the impeller, a motor having an output shaft for driving the impeller, a first radial clearance between the impeller and the output shaft of the motor, and a second radial clearance between an outer peripheral surface of the impeller and the pump housing, which is smaller than the first clearance.

17 Claims, 9 Drawing Sheets

II
IIA
1
40
10
40'
93
11
50
12
45
43
101
44
46
41
33
32
30
34
31
22
60
91
90
102
42
20
47
21
24
80
81
C
2
82
84
83
85
86
87
93
45
44
45
93
40
43
40'

PUMP APPARATUS

FIELD OF THE INVENTION AND RELATED ART STATEMENT

The present invention relates to a pump apparatus, and more particularly to a pump apparatus of the regenerative type, for pumping a fuel from a fuel tank in a vehicle to an engine thereof.

In such pump apparatus, a rotary shaft for carrying an impeller is rotatably journaled by bearings on opposite sides of the impeller in a pump housing, as disclosed in Japanese Patent Unexamined Publication No. 206795/82. That is, the rotary shaft extends through the impeller.

In another pump apparatus, a drive shaft of a motor is elongated and carrys an impeller as a rotary shaft, as disclosed in Japanese Utility Model Unexamined Publication No. 43692/84.

Some disadvantages are associated with the above pump apparatus. In the former the provision of the bearings on the opposite sides of the impeller results in an increase in the axial length of the whole pump apparatus. In the latter, a deflection or a bend of the drive shaft of the motor would, even if it is small, cause and amplify an irregular movement of the impeller. As a result, it would be necessary to provide a sufficient clearance between the pump housing and impeller to avoid a contact therebetween during operation. However, the provision of a large clearance might cause a pressure leak, and then a pumping efficiency is lowered.

SUMMARY OF THE INVENTION

An objection of the invention is to provide a pump apparatus having an improved pumping efficiency and a reduced axial length.

To this end, the pump apparatus according to the present invention comprises a pump housing defined by a hollow housing body and two end walls secured thereto; an impeller rotatably disposed in the pump housing; a first fluid passage for primarily pressurized fluid formed in the pump housing at one side of the impeller; a second fluid passage for secondarily pressurized fluid formed in the pump housing at the other side of the impeller; a plurality of radial grooves formed on a peripheral portion of each end surface of the impeller, each of which radially extends to an outer peripheral surface of the impeller; a motor including an output shaft for rotating and carrying at end portion thereof the impeller; a first radial clearance provided between the carrying end portion of the output shaft of the motor and the impeller; and a second radial clearance provided between the outer peripheral surface of the impeller and an inner periphery of the housing body for rotation of the impeller, and the second radial clearance being smaller than the first clearance.

The provision of the first radial clearance enables the impeller to loosely house the output shaft of the motor, so that the irregular movement of the impeller can be absorbed, which is caused by the deflection or the bend of the output shaft of the motor. This makes it possible to restrict an axial and radial deviation of the impeller, so that a second radial clearance between the impeller and the housing body can be sufficiently reduced. Therefore, a pressure leak in the pump apparatus is reduced and then the pumping efficiency thereof is increased.

Furthermore, according to the present invention, the impeller can be thus borne by the housing body, so that it is not necessary to journal the output shaft of the motor in both sides of the impeller. Therefore, it can be possible to reduce the number of bearings for the output shaft of the motor, so that a whole axial length of the pump apparatus is reduced.

The impeller can be assembled into the pump apparatus, after the motor is mounted therein, merely by disposing it into the pump housing and mounting it onto the end portion of the output shaft of the motor. This facilitates the mounting operation of the impeller into the pump apparatus and then improves the productivity.

The second radial clearance depends on only the dimensional precision of the outer diameter of the impeller. Therefore, in order to control the second radial clearance, it is necessary to precisely process only an outer contour of the impeller. The production of the impeller can be facilitated.

In one preferred embodiment of the invention, an outlet of a first fluid passage and an inlet of a second fluid passage are circumferentially displaced from each other to enable a communication passageway to obliquely across the axis of the impeller. An inlet of the first fluid passage and the inlet of the second fluid passage are aligned with each other while the outlet of the first fluid passage and an outlet of the second passage are aligned with each other. Accordingly, a fluid primarily pressurized in the first fluid passage can be smoothly flow to the second passage while a fluid pressure loss can be avoided. The inlets of the first and second passages are aligned with each other, and the outlets of both passages are also aligned with each other, thereby rendering the pressure applied to the impeller substantially uniform.

In another preferred embodiment of the invention, one intermediate chamber is defined between one end surface of the impeller and one end wall of the pump housing and another intermediate chamber is defined between the other end surface of the impeller and the other end wall of the pump housing. These two intermediate chambers are communicated with a fuel outlet port. An area of the intermediate chamber on the side of the first fluid passage projected on to the impeller is greater than that of the intermediate chamber on the side of the second fluid passage projected on to the impeller. The resultant of a force exerted on the impeller by a pressurized fluid in the first fluid passage and a force difference exerted on the impeller by a secondary pressurized fluid in the intermediate chambers can balance with the force exerted on the impeller by a secondary pressurized fluid in the second passage. Accordingly, it is possible to eliminate an axial deviation of the impeller.

In a further preferred embodiment of the invention, starting points of a first and a second fluid passages are aligned, and terminating points of the first and the second fluid passages are also aligned in a pump apparatus in which the fluid flows from the first fluid passageway to the second fluid passageway through a communication opening formed in a central portion of the impeller. Accordingly, no force of high magnitude is exerted radially on the impeller. This is conducive to a reduction of friction loss acting on the impeller and an improved efficiency of the pump apparatus. That is, the pump apparatus is capable of increasing a flow rate of fluid without dicreasing a discharge pressure, or the pump apparatus is able to serve as a regenerative pump of high performance while keeping its size compact.

DESCRIPTION OF THE PREFERRED EMBODIMENTS

Figures 1, 2A:
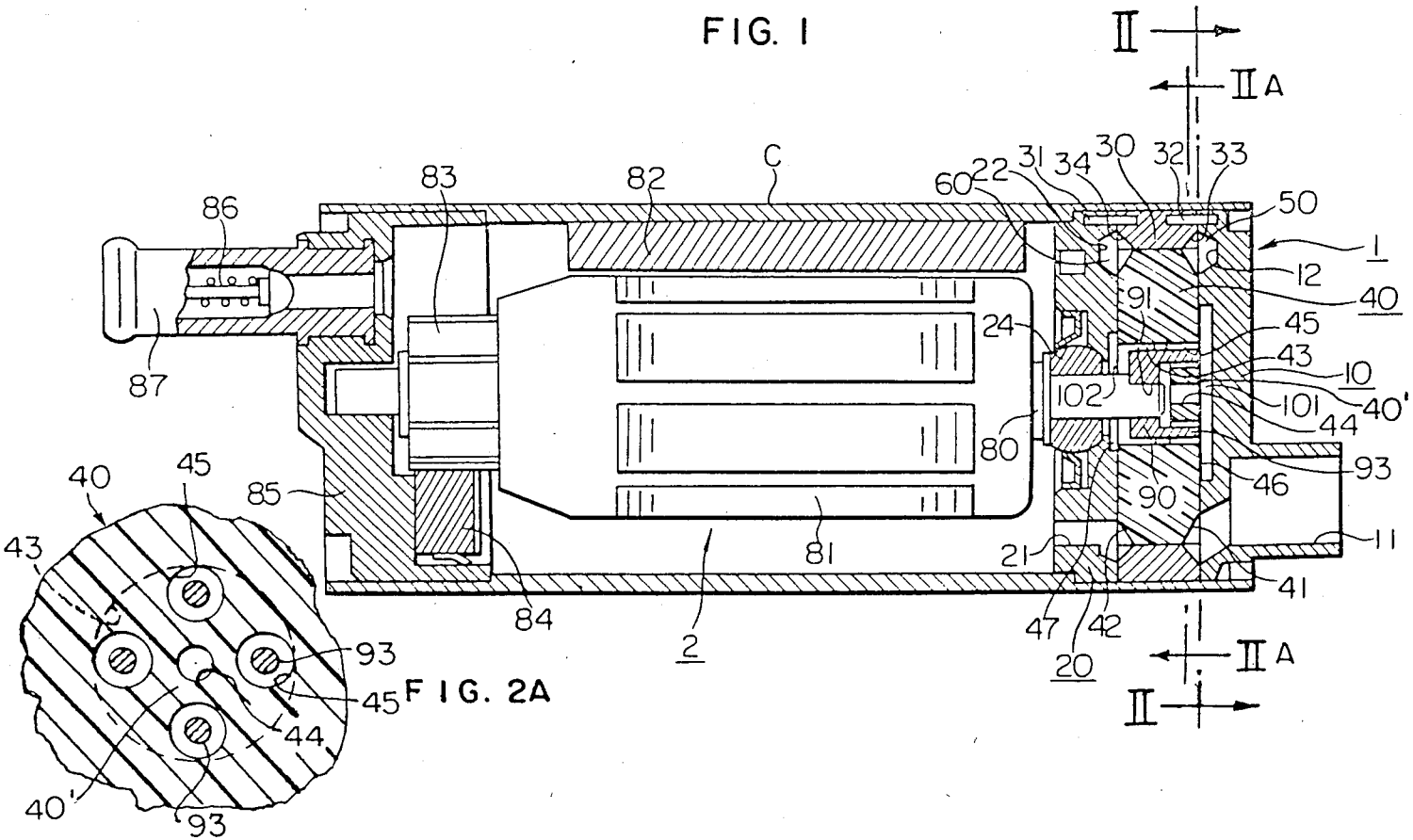
FIG. 1 is a longitudinal sectional view of a pump apparatus, as taken along the line I—I in FIG. 3, according to the first embodiment of the invention.
FIG. 2A is an enlarged fragmentary sectional view taken substantially along the line IIA—IIA in FIG. 1.

Referring to FIG. 1, a fuel pump of a vehicle according to one embodiment of the invention is shown. The fuel pump fuel from a fuel tank of the vehicle to an engine thereof.

The fuel pump comprises a pump housing 1 and a motor 2 both housed within a casing C. The pump housing 1 is defined by an end wall 10 on a primary side formed with a fuel inlet port 11, an end wall 20 on a secondary side formed with a fuel outlet port 21, and a housing body 30 between the end walls 10 and 20. The end walls 10 and 20 and the housing body 30 are assembled together into the pump housing 1 by positioning pins 31 and 32.

Rotatably disposed within the pump housing 1 is an impeller 40 which is made from a synthetic resin. The impeller 40 is provided at a peripheral portion of each end surface thereof with radial grooves 41 and 42 each of which radially extends to an outer periphery of the impeller 40.

The primary side end wall 10 is provided on an end surface thereof opposing the impeller 40 with a substantially annular groove 12 which extends circumferentially and faces with radial grooves 41. The annular groove 12 is circumferentially blocked by a partition 13 projecting radial inwardly. The secondary side end wall 20 is provided on an end surface thereof opposing the impeller 40 with a substantially annular groove 22 which extends circumferentially and faces with radial grooves 42. The annular groove 22 is circumferentially blocked by a partition 23 projecting radial inwardly, the same as the partition 13 of FIG. 2. The housing body 30 is provided at both end surfaces with substantially annular grooves 33 and 34 which face with the grooves 12 and 22, respectively. These annular grooves 33 and 34 are circumferentially blocked by partitions 35 and 36 formed on portions corresponding to the partitions 13 and 23 on the end walls 10 and 20, respectively (FIG. 3). The groove 12 on the end wall 10 cooperates with the groove 33 formed on the housing body 30 to define therebetween a substantially annular primary fuel passage 50. The groove 22 on the end wall 20 cooperates with the groove 34 formed on the housing body 30 to define therebetween a substantially annular secondary fuel passage 60. A groove 37 (FIG. 3) formed on an inner peripheral surface of the housing body 30 constitutes a communication passage 70 for maintaining communication between the two fuel passages 50 and 60.

Figure 2:
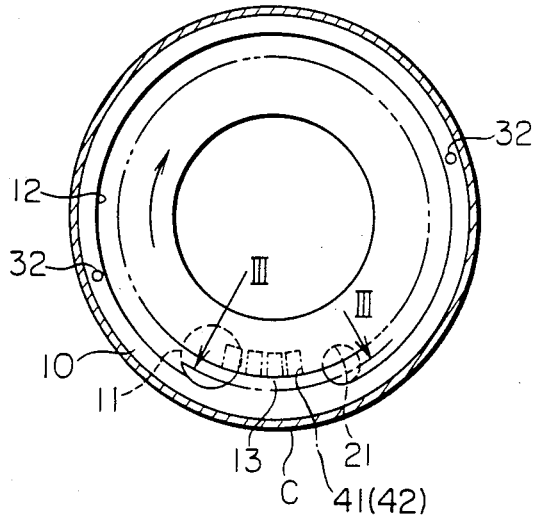
FIG. 2 is a sectional view taken along the line II—II in FIG. 1.
Figure 3:
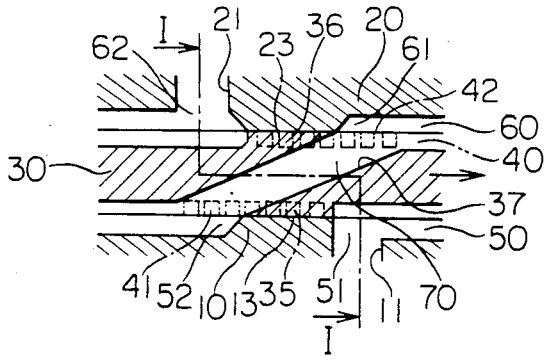
FIG. 3 is a sectional view taken along the line III—III in FIG. 2.

A fuel sucked through the fuel inlet port 11 is primarily pressurized within the primary fuel passage 50 as the impeller 40 rotates (in the direction of an arrow in FIGS. 2 and 3). The fuel thus primarily pressurized is delivered through the communication passage 70 to the secondary fuel passage 60 where the fuel is further pressurized as the impeller 40 rotates. The fuel thus secondarily pressurized is discharged through the fuel outlet port 21 into the motor 2.

The motor 2 comprises an output shaft 80, an armature 81 secured on the output shaft 80, permanent magnets 82 secured to the casing C for enclosing the armature 81, a commutator 83 secured to the output shaft 80 in a position adjacent the armature 81, and brushes 84 for supplying power to the motor 2. One end portion of the output shaft 80 is journaled by an end wall 85 which is secured to one end portion of the casing C. The end wall 85 is provided with a discharge pipe 87 mounting therein a check valve 86. The secondarily pressurized fuel is discharged from the fuel discharge port 21 into the motor 2 and then discharged from the discharge pipe 87.

Figure 4:
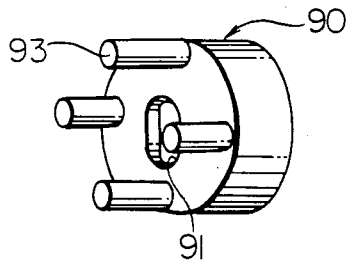
FIG. 4 is a perspective view showing one coupling member.
Figure 5:
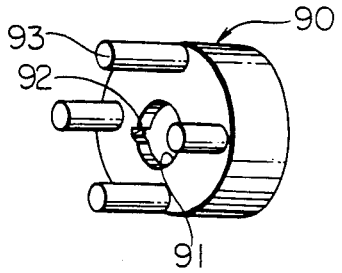
FIG. 5 is a perspective view showing another coupling member.

The connection between the impeller 40 and motor 2 will be described hereinunder. The output shaft 80 is at the other end portion thereof journaled by a bearing 24 supported by the end wall 20 and extends into a recess 43 formed in a central portion of the impeller 40. A coupling member 90 is secured to the other end of the output shaft 80, which is shown in FIG. 4 or 5. When the coupling member 90 is of a construction shown in FIG. 4, the other end portion of the output shaft 80 which is in a D-shaped cross section is inserted into a D-shaped through hole 91 formed in the coupling member 90 and they are rigidly secured together. When the coupling member 90 is of a construction shown in FIG. 5, the other end portion of the output shaft 80, on which a key way is formed is inserted into the coupling member 90 which is provided with a key way 92. A key (not shown) is fitted into both key ways to secure the coupling member 90 to the shaft 80. Four projections 93 project axial outwardly from one end surface of the coupling member 90.

A through hole 44 is formed in a central portion of a bottom 40' of the recess 43 of the impeller 40. Recesses 45 (through holes in the shown embodiment) are formed in the bottom of the recess 43, which are positioned in correspondence with axial projections 93 for receiving them, as shown best in FIG. 2A. Each hole 45 has an inner diameter larger than the outer diameter of the axial projection 93. The rotation of the motor 2 is transmitted to the impeller 40 through the output shaft 80 and the coupling member 90.

There are radial clearances between inner peripheral surfaces of the holes 45 and outer peripheral surfaces of the projections 93. The provision of the radial clearances enables the end portion of the output shaft 80 to loosely engage the impeller 40. Among these radial clearances, the largest clearance will be hereinafter referred to as a first radial clearance.

The housing body 30 has an inner diameter which is slightly greater than the outer diameter of the impeller 40, so that the housing body 30 can liquid-tightly enclose the outer periphery of the impeller 40. Although the housing body 30 liquid-tightly encloses the impeller 40, there is a smaller radial clearance between the outer periphery of the impeller 40 and the inner peripheral surface of the housing body 30 for permitting the impeller 40 rotate within the housing body 30. The greatest clearance among these clearance will be hereinafter referred to as a second radial clearance. According to the present invention, the second radial clearance is smaller than the first radial clearance. To strictly maintain the dimensional relationship between the first and the second clearances, the housing body is made from a material having a thermal expansion coefficient close to a thermal expansion coefficient of the material from which the impeller is made, such as grass fiber reinforced phenol resin.

In the abovementioned embodiment, an irregular movement, e.g. an eccentric rotation of the output shaft of the motor can be absorved, because the coupling member is accommodated fully (or partially) within the recess 43 of the impeller 40, and the projections 93 are loosely accommodated in the through holes 45 formed in the bottom of the recess 43 in the central portion of the impeller 40 or through the first radial clearance. Thus, the axial and radial deviation of the impeller can be avoided, so that it is possible to sufficiently reduce clearances between the impeller and pump housing, i.e. the second radial clearance and an axial clearance. Accordingly, the pressure leak in the pump is avoided and the pumping efficiency is improved.

Figure 6:
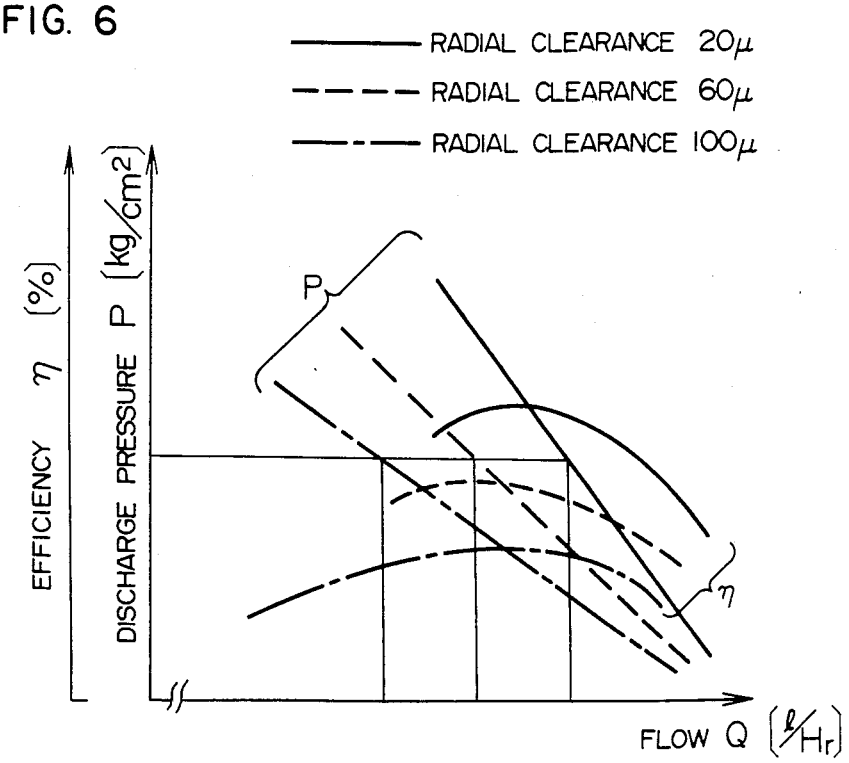
FIG. 6 is a diagram showing relationships among a radial clearance, a discharge pressure, a pumping efficiency and a discharge flow rate.

As apparent from the experimental data shown in FIG. 6, the smaller the second radial clearance becomes, the larger the flow of pressurized fluid becomes under the same discharge pressure thereof and the higher the pumping efficiency becomes.

The impeller is journaled by the housing body of the pump housing, so that it becomes possible to avoid journaling the output shaft on both sides of the impeller. This enables the number of bearings to the reduced and allows the whole axial dimension of the pump to be reduced.

The embodiment offers the additional advantages that the impeller can be readily assembled to the pump and that the dimensions of the impeller can be controlled with ease.

Referring to FIG. 3, an inlet 51 of the primary fuel passage 50 and an inlet 61 of the secondary fuel passage 60 are aligned with each other. An outlet 52 of the primary fuel passage 50 and an outlet 62 of the secondary fuel passage 60 are aligned with each other. The communication passage 70 extends obliquely across the axis of the impeller 40 to communicated the outlet 52 with the inlet 61. Accordingly, the fuel pressurized in the primary fuel passage 50 can be smoothly transferred through the communication passage 70 to the secondary fuel passage 60, so that a loss of fuel is reduced at communicating portions between the fuel passages and the communication passage.

Figure 8:
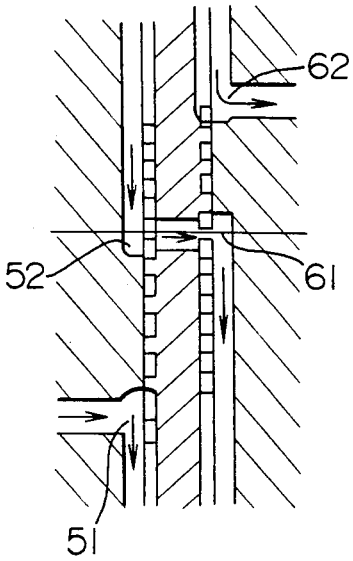
FIG. 8 PRIOR ART
FIG. 8 is a sectional view showing a communication passage of a conventional pump apparatus.
Figure 9:
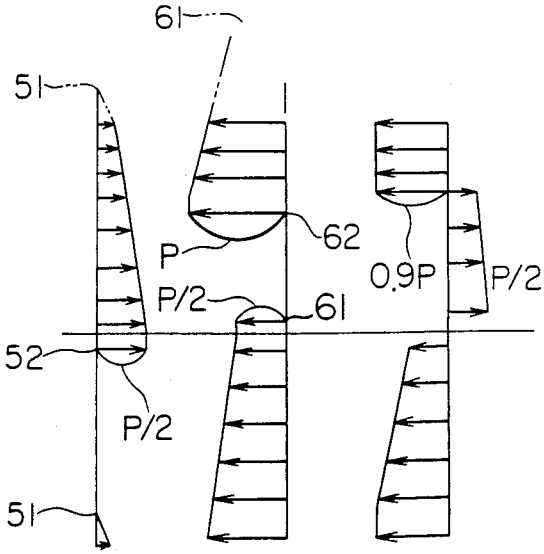
FIG. 9 PRIOR ART
FIG. 9 is a view showing a distribution of pressures acting on both ends surfaces of an impeller of a conventional pump apparatus and a resultant thereof.
Figure 10:
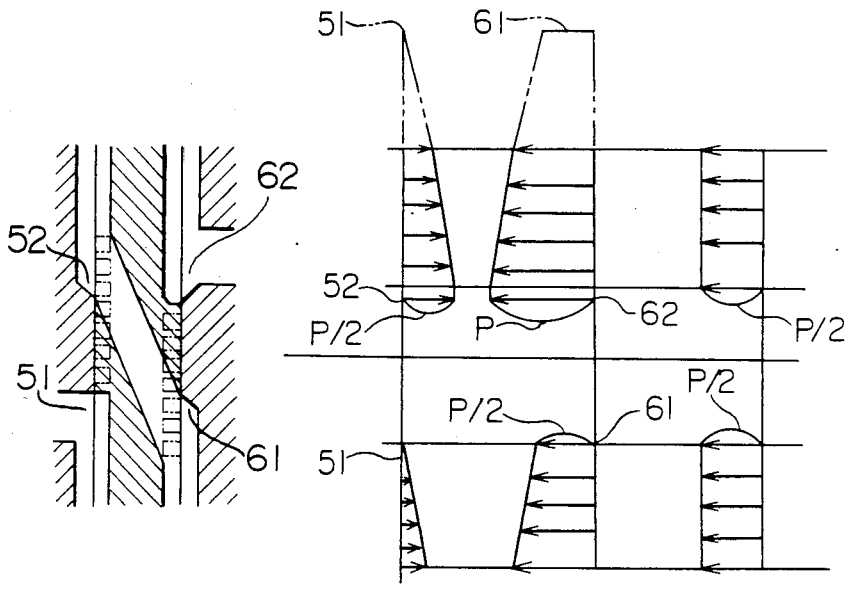
FIG. 10 is a view showing a distribution of pressures acting on both end surfaces of an impeller of a pump apparatus according to the invention and a resultant thereof.

The above mentioned arrangement of the inlets and outlets offers another advantage that, as shown in FIG. 10, the resultant of pressures applied to both surfaces of the impeller 40 becomes substantially uniform in direction and magnitude. More specifically, let the discharge pressure at the outlet 62 of the secondary fuel passage 60 be denoted by P. The pressure at the inlet 51 of the primary fuel passage 50 is O and then rises to P/2 at a constant pressure gradient until the fuel reaches the outlet 52. The fuel delivered to the inlet 61 of the secondary fuel passage 60 also has a pressure P/2 and is risen to the pressure P at the same pressure gradient as in the primary fuel passage 50 until the fuel reaches the outlet 62. The pressures of fuels in the primary and secondary fuel passageways 50 and 60 are applied to the impeller 40 from opposite directions, so that the resultant of pressures applied to the impeller 40 is oriented in the same direction and constant in magnitude (P/2) along a substantially entire circumference of the impeller 40. This eliminates the risk that the impeller 40 might be biased against and come into contact with the housing body 30. Meanwhile, in the prior art shown in FIGS. 8 and 9, the resultant of pressures applied to the impeller is oriented different directions along an entire circumference of the impeller and changes in magnitude. Thus, there is the danger that the impeller might be brought into contact with the pump housing.

Figure 11:
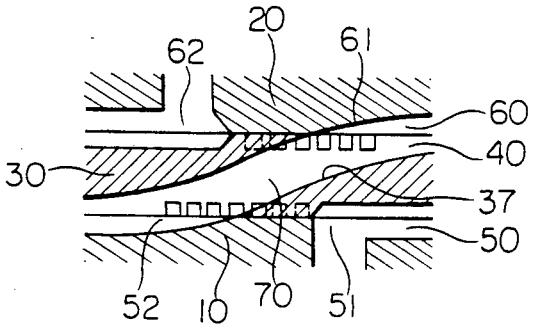
FIG. 11 is a sectional view showing another communication passage.

FIG. 11 shows a communication passage of another constructional form. In the figure, parts similar to, or performing the same function as those shown in FIG. 3 are designated by the same reference numerals. In this communication passage, the communication passage is in a curved form and is smoothly connected to the fuel passages, thereby further reducing a loss of fuel at communicating portions.

Figure 12:
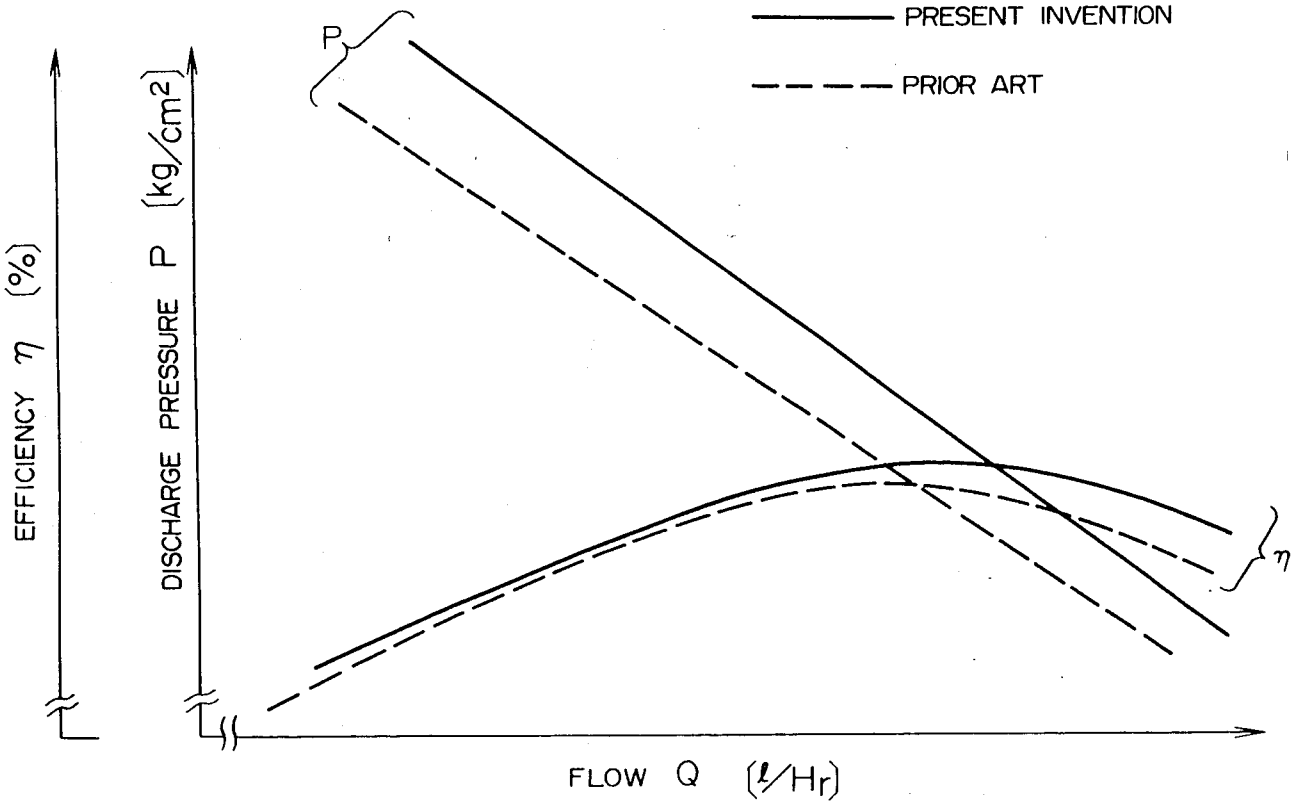
FIG. 12 is a diagram showing the performance of the pump apparatus shown in FIG. 3 in comparison with that of the conventional pump apparatus.

By virtue of the above arrangement of the communication passage and the communication passages, the fuel loss is substantially reduced, and the distribution of pressure applied to the impeller is uniformed. This makes it possible to avoid a contact between the impeller and the pump housing and to prevent a loss of torque of the motor. Also, the clearance between the impeller and the pump housing can be minimized. The performance of the pump according to the present invention is improved, as shown in FIG. 12, as compared with the prior art pump.

Referring to FIG. 1 again, the end wall 10 is provided at a portion of the end surface thereof facing an end surface 46 of the impeller 40 with a recess which cooperates with the impeller 40 to define an intermediate chamber 101 therebetween. The end wall 20 is provided at a portion of the end surface thereof facing an end surface 47 of the impeller 40 with a recess which cooperates with the impeller 40 to define an intermediate chamber 102 therebetween. As can be clearly seen in FIG. 1, the projection area of the intermediate chamber 101 projected on to the impeller 40 is greater than the projection area of the intermediate chamber 102 projected on to the impeller 40. During operation, the pressurized fuel discharged through the outlet port 21 is introduced through openings formed in the bearing 24 and a gap between the impeller 40 and the end wall 20 into the intermediate chamber 102 and further into the intermediate chamber 101 through the recess 43 and the through hole 44 in the impeller 40. The impeller 40 is urged toward the end wall 10 by the resultant of the pressure of the secondarily pressurized fuel in the secondary fuel passage 60 and the pressure of the fuel in the intermediate chamber 102. On the contrary, the impeller is urged toward the end wall 20 on by the resultant of the pressure of the primarily pressurized fuel in the primary fuel passage 50 and the pressure of the fluid in the intermediate chamber 101. Furthermore, since the projection area of the intermediate chamber 101 is greater than that of the intermediate chamber 102, the resultant of the pressure of the fuel in the primary fuel passageway 50 and the pressure of the fuel in the intermediate chamber 101 can be obtained to cancel the resultant of the pressures urging the impeller 40 toward the end wall 10. Accordingly, the impeller 40 is prevented from deviating axially and coming into contact with the housing body 30.

Another embodiment will be described hereinafter by referring to FIG. 7 in which parts similar to those shown in FIG. 1 are designated by the same reference numerals.

Figure 7:
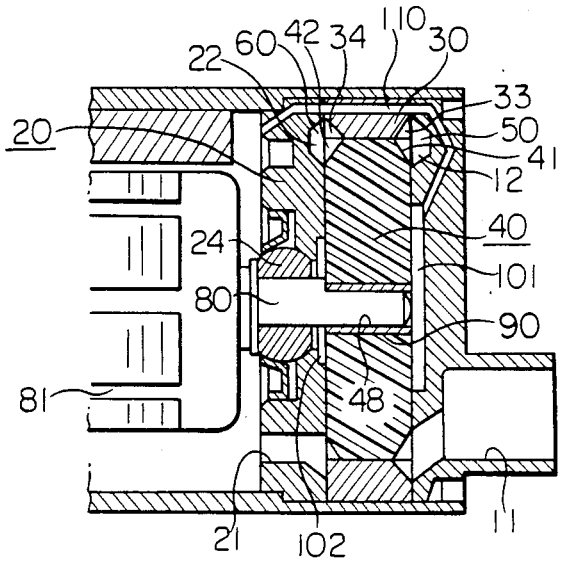
FIG. 7 is a fragmentary sectional view, showing a pump apparatus according to another embodiment of the invention.

In the embodiment shown in FIG. 7, the output shaft 80 is coupled to the impeller 40 through a rubber coupling member 90 interposed between an axial opening 48 formed in the impeller 40 and the output shaft 80, in order to enable the output shaft 80 to move axially without a relative rotation to the impeller 40.

There are a primary intermediate chamber 101 and a secondary intermediate chamber 102 located on opposite sides of the impeller 40, like the embodiment shown in FIG. 1. The intermediate chamber 102 is filled with a pressurized fuel introduced thereinto from the fuel outlet port 21 through the bearing 24. The intermediate chamber 101 is filled with a pressurized fuel introduced thereinto from the fuel outlet port 21 through a pressure introducing passage 110 formed in the pump housing. As can be clearly seen in the figure, the projection area of the intermediate chamber 101 projected on to the impeller 40 is greater than that of the intermediate chamber 102 projected on to the impeller 40. Accordingly, it is possible to avoid the axial deviation of the impeller 40, in the same manner as described by referring to the embodiment shown in FIG. 1.

In the embodiments shown in FIG. 1 or 7, the impeller is prevented from coming into contact with the pump housing, so that a loss of torque of the motor can be reduced and then the pumping performance can be improved. The deviation of the impeller can be also avoided, so that it is possible to arrange the impeller sufficiently close to the pump housing to provide a liquid-tight seal therebetween. This is conducive to a reduction in loss of fuel or in fall in pressure, and then the pumping performance is improved.

The volumetric relationship between the intermediate chamber 101 and 102 may be suitably decided depending on the pressure of the fuel secondarily pressurized in the secondary fuel passage 60. The intermediate chamber 102 on the secondary side may be formed by utilizing a recess formed in the impeller 40 in place of the recess formed at the end wall 20.

Figure 13:
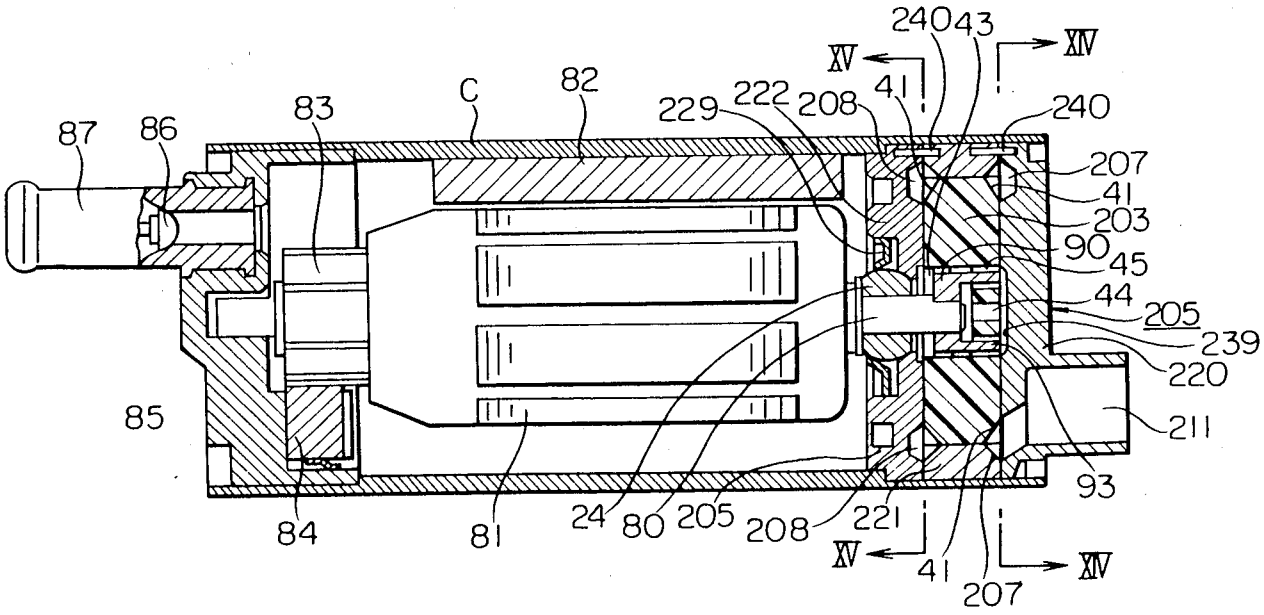
FIG. 13 is a longitudinal sectional view showing a pump apparatus according to still another embodiment of the invention.
Figure 14:
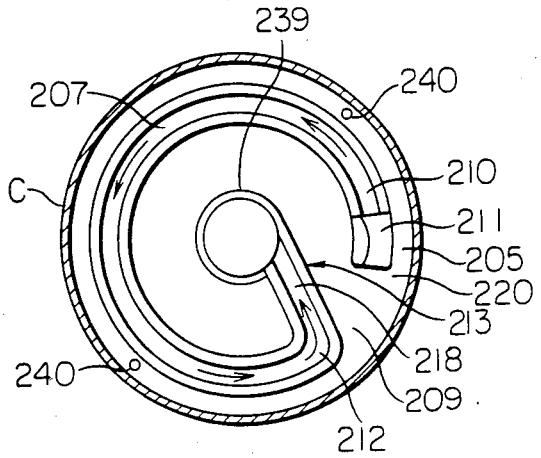
FIG. 14 is a sectional view taken along the line XIV—XIV in FIG. 13.
Figure 15:
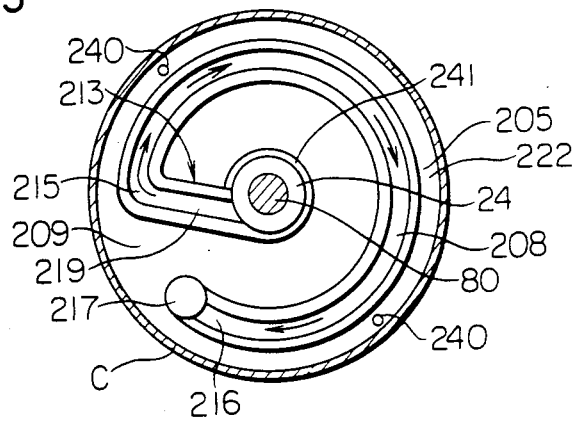
FIG. 15 is a sectional view taken along the line XV—XV in FIG. 14.

FIGS. 13–15 show still another embodiment of the invention. In these figures, parts similar to those shown in FIG. 1 are designated by the same reference numerals and the description thereto shall be omitted.

The reference numeral 229 designates a bearing retainer made of a resilient sheet metal. The bearing retainer 229 holds the bearing 24 and is formed with a plurality of apertures allowing a fluid to flow therethrough.

An inlet housing 220 constituting a pump case 205 is located adjacent an impeller 203. The inlet housing 220 is formed with a recess 239 in a central portion thereof. A intermediate housing 221 is located adjacent the inlet housing 220, and they are assembled together by positioning pins 240. An outlet housing 222 constitutes a part of the pump case 205, which holds the bearing retainer 229 and the bearing 24. The outlet housing 222 is located adjacent the intermediate housing 221, and they are also assembled together by the positioning pins 240.

In FIG. 13, both sides of the impeller 203 are communicated with each other through the recess 43 and the through hole 44, and through the recess 43 and the clearances between the projections 93 of the coupling member 90 and the through holes 45 for accommodating the respective projections 93.

Referring to FIG. 14, a fluid which is a fuel gasoline in a fuel tank in this case is drawn from an inlet port 211 into a primary stage passage 207 having a C-shaped form and being formed on one side of the impeller 203. The fluid flows in a direction indicated by arrows from a starting point 210 to a terminating point 212 in the primary passage 207 and further flows to a recess 239 in the central portion of the inlet housing 220 through a primary connection passage 218 constituting a communication passage 213.

The fuel in the recess 239 flows through the above-mentioned communication means to the other side of the impeller 203 and further flows to a recess 241 in the outlet housing 222, as shown in FIG. 15. Then, the fuel flows through a secondary connection passage 219 and flows from a starting point 215 to a terminating point 216 of a secondary passage 208. the pressurized fuel is discharged from a fuel outlet port 217 to a periphery of a rotor 81 located outside the outlet housing 222. The reference numeral 209 designates a partition wall.

Figure 16:
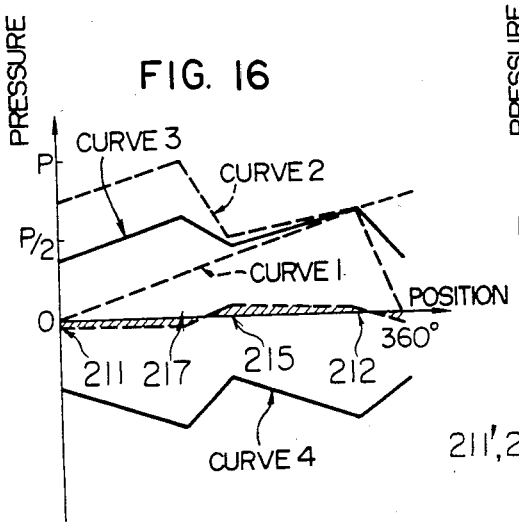
FIG. 16 is a diagram showing curves representing the radial pressures acting on the impeller of the pump apparatus shown in FIGS. 13 to 15.

The distribution of hydraulic pressure acting on a peripheral surface of the impeller 203 will be described. In the diagram shown in FIG. 16, the ordinate represents the pressure applied to the peripheral surface of the impeller 203 and the abscissa indicates an angle for indicating positions on the peripheral surface of the impeller 203. The angle O indicates a position in the vicinity of the inlet port 211. FIG. 16 shows the distribution of pressure as measured through an extent of 360 degrees in the direction of rotation of the impeller 203. The numerals 217, 215 and 212 in the diagram designate positions on the peripheral surface of the impeller 203, i.e. the vicinity position of the inlet port 211, the starting point 215 of the secondary passage 208 and the vicinity position of the terminating point 212 of the primary passage 207, respectively.

In FIG. 16, a curve 1 shows the pressure of the fuel pressurized in the primary passage 207, which acts on the peripheral surface of the impeller 203. It will be seen that the pressure gradually rises as the fuel flows from the inlet port 211 and reaches a level P/2 at the terminating point 212 of the primary passage 207. P designates a pressure in the vicinity of the outlet port 217. A curve 2 shows the pressure of the fuel pressurized in the secondary passage 208, which acts on the peripheral surface of the impeller 203. It will be seen that the pressure at the level P/2 at the starting point 215 of the secondary passage 208 gradually rises as the fuel flows through the secondary passageway 208 and reaches a level P at the outlet port 217. The peripheral surface of the impeller 203 is in contact with the primary and the secondary passages 207 and 208, so that the peripheral surface of the impeller 203 is affected by the pressure represented by the curve 1 and the pressure represented by the curve 2 from opposite directions. Thus, a means pressure of the pressure of curve 1 and the pressure of curve 2, i.e. a pressure indicated by a curve 3 is applied to the peripheral surface of the impeller 203.

Meanwhile, a curve 4 which is drawn based on the curve 3 represents radially oriented pressure applied to a portion of the peripheral surface of the impeller 203, which is circumferentially spaced by an extent of 180 degrees from the portion thereof at which the pressures of the curve 3 is applied. The curve 4 can be readily drawn by merely plotting a pressure of the curve 3 in a manner of 180° out of phase. That is, the curve 3 represents pressures applied to the peripheral surface of the impeller 203 at each angular positions, and the curve 4 represents pressures applied to the peripheral surface of the impeller 203 at 180° out of phase angular positions. The actual pressure force applied to the impeller 203 is resultant of pressure forces in curves 3 and 4, which urges the impeller against the inner peripheral surface of the pump case 205 or against the coupling member 90 secured to the output shaft 80 for driving the impeller 203. That is, such actual pressure force is equal to a force obtained by subtracting the pressure force in curve 4 from the pressure force in curve 1. A hatched region in the diagram shown in FIG. 16 represents such actual pressure force. It will be readily seen that it is very low.

Figure 17:
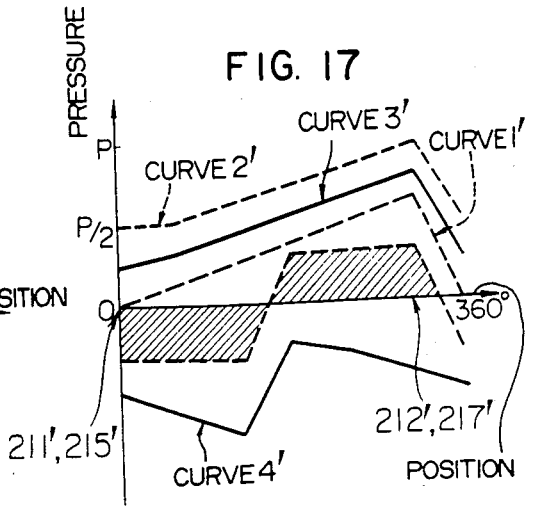
FIG. 17 is a diagram showing curves representing the radial pressures acting on the impeller of the conventional pump apparatus.

FIG. 17 is a diagram showing the corresponding radially oriented pressure applied to the impeller in the prior art pump. In the diagram, portions designated by the reference numerals 211' and 215' correspond to an inlet port and a starting point of secondary passage. The portions 211' and 215' are located in the substantially same circumferential position. Portions designated by the reference numerals 212' and 217' correspond to a terminating point of a primary passageway and an outlet port. In the diagram, a curve 1' represents a pressure in the primary passage applied to the peripheral surface of the impeller 203. It will be seen that the pressure represented by the curve 1' gradually rises as the fluid flows from the inlet port 211' and reaches a level P/2 at the terminating point 212'. A curve 2' represents a pressure in the secondary passage applied to the peripheral surface of the impeller. As indicated by the curve 2', the fluid has a pressure which is substantially at a level P in the outlet portion 217' and a pressure which is at a level P/2 in the starting point 215'. A curve 3' represents a mean pressure of the pressures indicated by the curves 1' and 2'. A curve 4' is drawn by merely plotting a pressure of the curve 3' in a manner of 180° out of phase. In the diagram, a hatched region represents an actual pressure force which urges the impeller against the inner peripheral surface of the pump or against the coupling member. As compared with the hatched region shown in FIG. 16, the hatched region shown in FIG. 17 is much larger. It is readily noticed that a higher frictional force is generated between the impeller and pump case.

Figure 18:
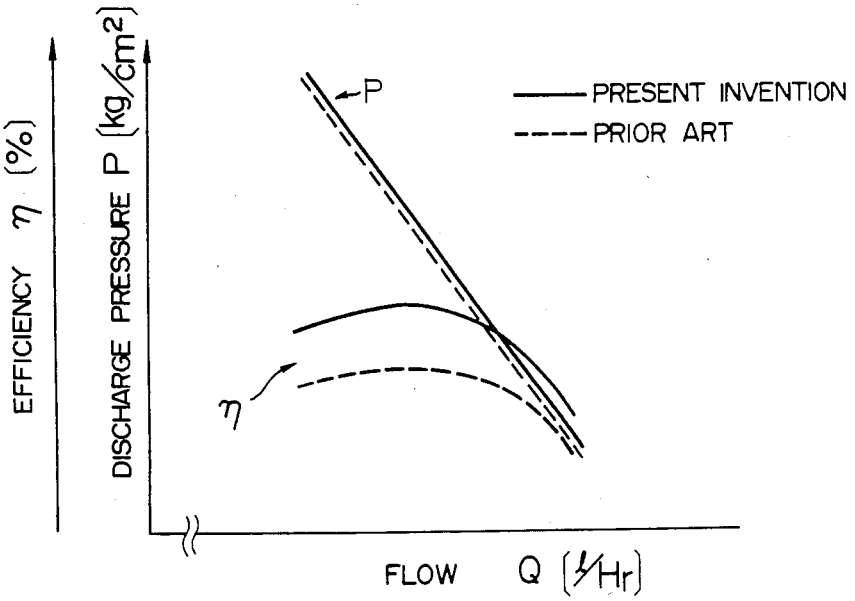
FIG. 18 is a diagram showing changes of the pumping efficiency and discharge pressure in relation to the flow rate, in the pump apparatus shown in FIGS. 13 to 15 and the conventional pump apparatus.

FIG. 18 shows efficiencies $\eta$ and discharge pressures P of the embodiment shown in FIGS. 13 to 15, and the prior art pump. Abscissa presents the flow Q, and a solid line and a dotted line represents the embodiment of the invention and the prior art, respectively. It will be seen that the pump according to the invention is higher in efficiency and has a higher discharge pressure at the same flow than the prior art.

Figure 19:
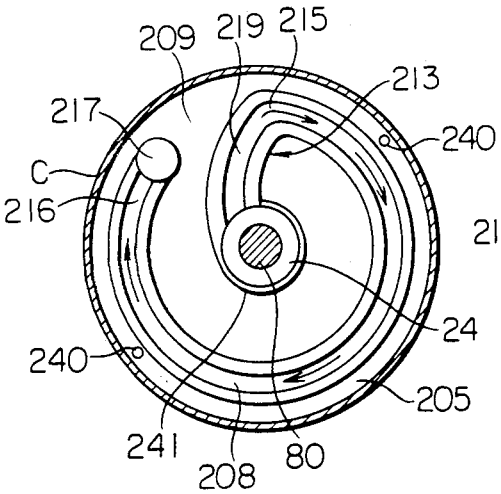
FIGS. 19 and 20 are sectional views showing further embodiments of the invention.
Figure 20:
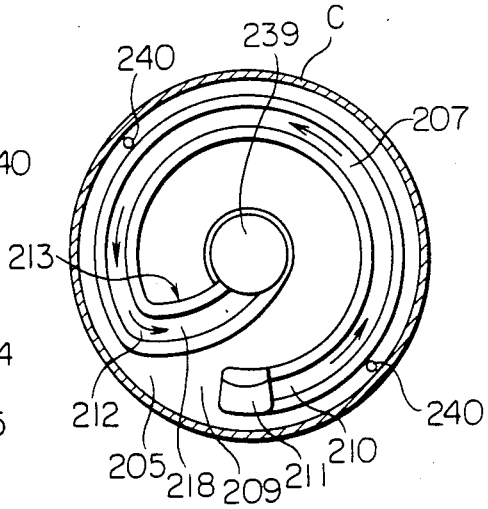

A further embodiment of the invention will be described by referring to FIGS. 19 and 20, in which the primary connection passage 218 and secondary connection passage 219 both constituting the communication passage 213 are curved. As shown in FIG. 20, the primary connection passage 218 is so curved that the fluid flows smoothly from the end of the primary passage 207 toward the central recess 239. As shown in FIG. 19, the secondary connection passage 219 is also curved so that the fluid flows smoothly out of from the central recess 241 toward the secondary passage 208. By this arrangement, it is possible to avoid a sudden change in the direction of flow of the fluid flowing from the primary passage 207 into the primary connection passage 218 because there is no sharp bend between them. It is also possible to avoid a sudden change in the direction of flow of the fluid flowing from the secondary connection passage 218 into the second passage 208 because there is no sharp bending between them. This is conducive to a reduced friction loss of the fluid.

What is claimed is:

1. A pump apparatus comprising:

a pump housing defined by a hollow housing body and two end walls secured to said housing body;

a single impeller rotatably disposed in said pump housing, said impeller being enclosed at an outer periphery thereof of an inner periphery of said housing body in a substantially liquid-tight manner, whereby said impeller is journaled at said outer periphery thereof in said inner periphery of said housing body;

a first fluid passage for primarily pressurized fluid defined by said impeller and said pump housing at one side of said impeller, said fist fluid passage including an inlet and an outlet;

a second fluid passage for secondarily pressurized fluid defined by said impeller and said pump housing at the other side of said impeller, said second fluid passage including an inlet and an outlet;

a plurality of radial grooves formed on a peripheral portion of each end surface of said impeller, each of which radially extends to an outer peripheral surface of said impeller;

a motor including an output shaft for rotating and carrying at an end portion thereof said impeller;

a first radial clearance provided between said carrying end portion of said output shaft of said motor and said impeller; and a second radial clearance provided between said outer peripheral surface of said impeller and an inner periphery of said housing body for rotation of said impeller, and said second radial clearance being smaller than said first clearance, whereby a radial movement of said impeller is restricted.

2. A pump apparatus according t claim 1, wherein said apparatus further comprises a communication passage formed on said housing body for communicating the outlet of said first fluid passage with the inlet of said second fluid passage, and wherein the outlet of said first fluid passage and the inlet of said second fluid passage are displaced from each other, and the inlets of said first and second fluid passages are circumferentially aligned with each other, and the outlets of said first and second fluid passages are circumferentially aligned with each other.

3. A pump apparatus according to claim 1, wherein said apparatus further comprises a first intermediate chamber defined by said impeller and the end wall of said pump housing facing said first fluid passage, and a second intermediate chamber defined by said impeller and the end wall of said pump housing facing said second fluid passage, and wherein a projection area of said first intermediate chamber projected on said impeller is larger than that of said second intermediate chamber, and wherein said both intermediate chambers are communicated with the outlet of said second fluid passage.

4. A pump apparatus according to claim 1, wherein each fluid passage has a generally annular shape and is partially interrupted by a wall portion projecting radialy inwardly from said pump housing, and wherein the inlet of said first fluid passage is circumferentially spaced by about 180 degrees from the inlet of said second fluid passage and the outlet of said first fluid passage is circumferentially spaced by about 180 degrees from the outlet of said second fluid passage, and wherein said apparatus further comprises communicating means for communicating the outlet of said first fluid passage with the inlet of said second fluid passage, said communicating means including an axial through hole formed in a center portion of said impeller, a first connecting passage section for connecting the outlet of said first fluid passage with said axial through hole, and a second connecting passage section for connecting the inlet of said second fluid passage with said axial through hole.

5. A pump apparatus according to claim 1, wherein said apparatus further comprises: a coupling member mounted onto the output shaft of said motor without relative rotational and axial movements therebetween, said coupling member being provided with at least one projection projecting off center from one end surface thereof and a recess being formed in said impeller for at least partially receiving said coupling member for relative radial and axial movements therebetween, said recess being provided in a bottom thereof with at least one recess for at least partially receiving said projection, said one recess being oversize with respect to said projection to thereby permit relative radial and axial movements between said shaft and said impeller.

6. A pump apparatus according to claim 5, wherein said recess bottom has an axial through bore.

7. A pump apparatus according to claim 2, wherein said both fluid passages are connected to said communication passage through smoothly curved connecting portions.

8. A pump apparatus according to claim 4, wherein said first connecting passage section is connected to said first fluid passage through smoothly curved connecting portion, and said second connecting passage section is connected to said second fluid passage through smoothly curved connecting portion.

9. A pump apparatus according to claim 3, wherein said apparatus further comprises a pressure introducing passage formed in said pump housing for communicating said first intermediate chamber with the outlet of said second fluid passage, and a bearing means for journaling the output shaft of said motor, said bearing means disposed in the end wall of said pump housing facing said second fluid passage and provided with at least one opening through which said second intermediate chamber is communicated with the outlet of said second fluid passage.

10. The apparatus defined in claim 1 including coupling means drivingly connecting said shaft end portion to said impeller while permitting relative radial movement therebetween.

11. The apparatus defined in claim 1 including coupling means drivingly connecting said shaft end portion to said impeller while permitting relative axial movement therebetween.

12. The structure defined in claim 1 including coupling means drivingly connecting said shaft end portion to said impeller while permitting relative radial and axial movements therebetween.

13. A pump apparatus comprising:

a pump housing defined by a hollow housing body and two end walls secured to said housing body;

a single impeller rotatably disposed in said pump housing, said impeller being enclosed at an outer periphery thereof by an inner periphery of said housing body in a substantially liquid-tight manner, whereby said impeller is journaled at said outer periphery thereof in said inner periphery of said housing body;

a first fluid passage for primarily pressurized fluid defined by said impeller and said pump housing at one side of said impeller, said first fluid passage including an inlet and an outlet;

a second fluid passage for secondarily pressurized fluid defined by said impeller and said pump housing at the other side of said impeller, said second fluid passage including an inlet and an outlet;

a plurality of radial grooves formed on a portion of each end surface of said impeller;

a motor including an output shaft for rotating and carrying at an end portion thereof said impeller;

a first intermediate chamber defined by said impeller and the end wall facing said first fluid passage;

a second intermediate chamber defined by said impeller and the end wall facing said second fluid passage;

a projection area of said second intermediate chamber projected on said impeller being smaller than that of said first intermediate chamber; and communication means for communicating said both intermediate chambers to the outlet of said second fluid passage.

14. The apparatus defined in claim 13 including coupling means drivingly connecting said shaft end portion to said impeller while permitting relative radial movement therebetween.

15. The apparatus defined in claim 13 including coupling means drivingly connecting said shaft end portion to said impeller while permitting relative axial movement therebetween.

16. The structure defined in claim 13 including coupling means drivingly connecting said shaft end portion to said impeller while permitting relative radial and axial movements therebetween.

17. A pump apparatus comprising;

a pump housing defined by a hollow housing body and two end walls secured to said housing body;

an impeller rotatably disposed in said pump housing;

a first fluid passage for primarily pressurized fluid defined by said impeller and said pump housing at one side of said impeller, said first fluid passage having a generally annular shape and partially interrupted by a wall portion projecting radially inwardly from said pump housing, said first fluid passage including an inlet and an outlet;

a second fluid passage for secondarily pressurized fluid defined by said impeller and said pump housing at the other side of said impeller, said second fluid passage having a generally annular shape and partially interrupted by a wall portion projecting radially inwardly from said pump housing, said second fluid passage including an inlet which is circumferentially spaced by about 180 degrees from the inlet of said first fluid passage, and an outlet which is circumferentially spaced by about 180 degrees from the outlet of said first fluid passage;

a plurality of radial grooves formed on a portion of each end surface of said impeller;

a motor including an output shaft for rotating and carrying at an end portion thereof said impeller; and communicating means for communicating the outlet of said first fluid passage with the inlet of said second fluid passage, said communicating means including an axial through hole formed in a center portion of said impeller, a first connecting passage section for connecting the outlet of said first fluid passage with said axial through hole, and a second connecting passage section for connecting the inlet of said second fluid passage with said axial through hole

* * * * *